US011594833B2

(12) United States Patent
Metzler et al.

(10) Patent No.: US 11,594,833 B2
(45) Date of Patent: Feb. 28, 2023

(54) PLUG CONNECTOR WITH SECONDARY LOCK

(71) Applicant: HIRSCHMANN AUTOMOTIVE GMBH, Rankweil/Brederis (AT)

(72) Inventors: Andreas Metzler, Hohemus (AT); Markus Kalb, Dornbirn (AT)

(73) Assignee: HIRSCHMANN AUTOMOTIVE GMBH, Rankweil/Brederis (AT)

( * ) Notice: Subject to any disclaimer, the term of this patent is extended or adjusted under 35 U.S.C. 154(b) by 278 days.

(21) Appl. No.: 16/629,238

(22) PCT Filed: Sep. 7, 2018

(86) PCT No.: PCT/EP2018/074138
§ 371 (c)(1),
(2) Date: Jan. 7, 2020

(87) PCT Pub. No.: WO2019/048614
PCT Pub. Date: Mar. 14, 2019

(65) Prior Publication Data

US 2020/0227856 A1 Jul. 16, 2020

(30) Foreign Application Priority Data

Sep. 7, 2017 (DE) ..... 102017120579.9

(51) Int. Cl.
*H01R 13/42* (2006.01)
*H01R 13/422* (2006.01)
(Continued)

(52) U.S. Cl.
CPC ..... *H01R 13/4223* (2013.01); *H01R 13/424* (2013.01); *H01R 13/514* (2013.01); *H01R 13/6272* (2013.01); *H01R 13/6273* (2013.01)

(58) Field of Classification Search
CPC ..... H01R 13/4223; H01R 13/424; H01R 13/514; H01R 13/6272
(Continued)

(56) References Cited

U.S. PATENT DOCUMENTS 6,264,497 B1 * 7/2001 Murakami ..... H01R 4/2433 439/417
7,347,745 B1 * 3/2008 Raudenbush ..... H01R 24/40 439/752
(Continued)

FOREIGN PATENT DOCUMENTS

FR 2831721 A 5/2003

*Primary Examiner* — Alexander Gilman
(74) *Attorney, Agent, or Firm* — Andrew Wilford

(57) ABSTRACT

The invention relates to a plug connection (1) having a plug connector (2) and a mating plug connector (3). The plug connector (2) and the mating plug connector (3) can be plugged together in order to form the plug connection (1), wherein the plug connector (2) has a contact support (4) with at least one contact chamber for receiving a contact partner, and the contact support (4) is inserted into an outer housing (5) of the plug connector (2). Each contact partner is primarily locked in the contact chamber of the contact partner, and a secondary lock (6) is provided for a secondary locking of the contact partners in the contact chambers thereof. The invention is characterized in that the secondary lock (6) is formed by a longitudinal web (16), at the two ends of which a respective latching element (17) is arranged that interacts with the contact support (4), and at least one force absorbing web (19) is arranged on the upper face of the longitudinal web (16).

5 Claims, 13 Drawing Sheets

(51) Int. Cl.
*H01R 13/514* (2006.01)
*H01R 13/627* (2006.01)
*H01R 13/424* (2006.01)

(58) Field of Classification Search
USPC ..... 439/595
See application file for complete search history.

(56) References Cited

U.S. PATENT DOCUMENTS 7,500,887 B2 * 3/2009 Ichio ..... H01R 13/4362 439/752
7,540,756 B1 * 6/2009 Strahl ..... H01R 13/6275 439/344
7,544,081 B2 * 6/2009 Lim ..... H01R 13/4361 439/352
7,556,539 B2 * 7/2009 Takahashi ..... H01R 13/4362 439/752
7,682,205 B2 * 3/2010 Hall ..... H01R 27/02 439/752
8,328,581 B2 * 12/2012 De Chazal ..... B60L 3/00 439/620.28
9,160,095 B2 * 10/2015 Littek ..... H01R 13/641
9,917,381 B1 * 3/2018 Campbell ..... H01R 9/24
9,929,509 B1 * 3/2018 Penn ..... H01R 13/6275
10,109,955 B2 * 10/2018 Holub ..... H01R 13/64
11,031,726 B2 * 6/2021 Kim ..... H01R 13/6273
11,139,605 B2 * 10/2021 Metzler ..... H01R 13/514
2005/0075001 A1 * 4/2005 Shearman ..... H01R 43/26 439/352
2012/0094509 A1 * 4/2012 Bryan ..... B60Q 11/005 439/76.1
2012/0208400 A1 * 8/2012 De Chazal ..... H01R 13/506 439/607.58
2017/0170604 A1 * 6/2017 Endo ..... H01R 12/707
2017/0207578 A1 * 7/2017 Abraham ..... H01R 13/4362
2017/0207594 A1 * 7/2017 Jabrane ..... H01R 13/6272
2020/0227856 A1 * 7/2020 Metzler ..... H01R 13/424
2022/0115807 A1 * 4/2022 Anderson ..... H01R 13/5825
2022/0123502 A1 * 4/2022 Hofmann ..... H01R 13/639

* cited by examiner

PLUG CONNECTOR WITH SECONDARY LOCK

CROSS REFERENCE TO RELATED APPLICATIONS

This application is the US-national stage of PCT application PCT/EP2018/074138 filed 7 Sep. 2018 and claiming the priority of German patent application 102017120579.9 itself filed 7 Sep. 2017.

FIELD OF THE INVENTION

The invention relates to a plug connection comprising a plug connector and a mating plug connector.

BACKGROUND OF THE INVENTION

In such a connection the plug connector and the mating plug connector may be plugged together to form the plug connection, wherein the plug connector has a contact support having at least one contact chamber for receiving a contact and the contact support is inserted into an outer housing of the plug connector, wherein each contact is primarily latched in its contact chamber and a secondary latch is provided so as to secondarily latch the contacts in their contact chambers.

Plug connectors of such plug connections that comprise a contact support are known. The contact support has at least one contact chamber, generally multiple contact chambers, into which is inserted in each case a contact. The contact is at the end of the electrical conductor. In order for the plug connector to function in a reliable manner, the contact is primarily latched in its associated contact chamber. This latching arrangement is produced by way of example by a resilient tab that projects out of the contact and comes into contact with an undercut in the contact chamber if the contact when in its intended desired position has been inserted into the contact chamber.

Furthermore, it is known that the contact is not only primarily latched in its contact chamber but that a so-called secondary latching procedure is also performed. Such a secondary latching procedure is performed by way of example using latching tabs, latching latches or the like.

In order for the plug connection to function during operation, i.e. when the plug connector has been inserted into the mating plug connector, it is necessary for these two elements to be permanently and reliably connected to one another. Latching elements for this purpose are already known, so-called CPAs (connector position assurance).

However, it is in addition also necessary in order for the plug connector of the plug connection to function that the contact support is reliably and permanently secured in its intended desired position. Depending upon the embodiment of the plug connector, this intended desired position may be a final position when the contact support has been inserted into the outer housing. However, this intended desired position may also be a pre-latching position into which the contact is initially moved with regard to the outer housing, wherein subsequently further measures (such as for example inserting the contacts) are performed and the contact support is only afterwards moved into its intended final position into the outer housing. In both cases, it is possible in a disadvantageous manner that although the contact support has been inserted into its outer housing this contact support may during the course of further assembly or plugging-in procedures move back out of this position with the result that these further assembly and plugging-in procedures may not be performed reliably, i.e. are encumbered with errors.

OBJECT OF THE INVENTION

The object of the invention is therefore to improve a plug connector of the generic type and to avoid the disadvantages mentioned in the introduction.

SUMMARY OF THE INVENTION

It is provided in accordance with the invention that the secondary latch is formed by a longitudinal bar and a latching element that cooperates with the contact support is on each of the two ends of this longitudinal bar, wherein at least one force-absorbing bump is on the upper face of the longitudinal bar. The contacts are secondary latched in their contact chambers by the longitudinal bar when the secondary latch has been moved from a first position into a second position after the contacts have been inserted into their contact chambers and are initially primarily latched there. In order for the secondary latch to be secured in the contact support, this secondary latch has on each of its two ends a latching element that cooperates with a corresponding geometric shape in the contact support. So as to actuate the secondary latch, at least one force-absorbing bump, for example in the form of an elevated region, furthermore in particular in the form of a rectangular or rather cuboid elevation, is on the upper face of the longitudinal bar of the secondary latch and the secondary latch may be actuated by this at least one force-absorbing bump.

It is provided in one development of the invention that the longitudinal bar of the secondary latch has an insertion chamfer. The insertion chamfer renders it possible to insert the contacts without a problem into the contact chambers over the entire length of the longitudinal bar between the two latching elements into the contact chambers, since during this insertion procedure the longitudinal bar does not hinder the movement of the contacts into their contact chambers when this longitudinal bar is located in its first position in the contact support, this first position still not secondary latching the contacts. Consequently, a stop surface is omitted against which the contacts could impact as they are inserted into their contact chambers and their insertion movement would be blocked. The insertion chamfer of the secondary latch effectively prevents this contacts from impacting against a stop surface and becoming jammed.

It is provided in one development of the invention that the longitudinal bar of the secondary latch has an unlatching notch near its latching elements. These unlatching notches render it possible for the secondary latch to be moved from its latched position in the contact support (in which this secondary latch latches the contacts) by a tool that is placed from the outside against the contact support into an unlatched position in which the contacts are released (or conversely), so that they may for example be replaced or exchanged in the event of damage.

It is provided in one development of the invention that the longitudinal bar of the secondary latch has a coding. This coding renders it possible by way of example to establish which contact support the secondary latch is to be used for. The coding thus provides information as to which contact support the respective secondary latch is to be inserted into, irrespective of the number of contact chambers in the respective contact support and consequently according to the number of contacts. This coding may be mechanically queried with the result that it is possible to select and assemble the corresponding secondary latch (and furthermore also the outer housing that matches the contact support) in dependence upon each contact support.

The above described secondary latch is thus configured in such a manner that the contact support may then only be moved and completely inserted into its associated outer housing if the secondary latch is not located in its first position but rather is located in its intended final position in the contact support, the secondary latch being used in the this intended final position to secondarily latch the contacts. This increases the reliability of the assembly of the entire plug connector, since it is consequently possible to check whether all the contacts have been inserted in the intended manner into their contact chambers and whether they are not only primarily latched but rather also secondary latched in this contact chambers. This is because it is not possible to perform the secondary latching procedure as long as each contact is not inserted in the intended manner into its associated contact chamber, since in such a case the secondary latch may not be actuated and is mounted in such a manner in the contact support that renders it possible to fully insert and secure the contact support in its outer housing. Furthermore, the secondary latch in accordance with the invention renders it possible on account of the force-absorbing bumps on the longitudinal bar to absorb the contact holding-forces in a robust manner. It is consequently possible in an advantageous manner to realize a miniature construction of the plug connector. Moreover, it is possible to detect the first position (pre-latched position) and the second intended final position (final latched position) of the secondary latch in the contact support in the assembled state in these two positions, i.e. to check this positions with the result that at least two testing options are possible. It is also possible to latch and unlatch the secondary latch in the contact support in a simple manner, since this latching arrangement is provided by a simple latching procedure. By virtue of simply moving (unlatching) the secondary latch in the contact support (starting from the final latched position the secondary latch is moved into its pre-latched position), the contacts may be replaced in a simple and rapid manner in the fully assembled state. A further advantage resides in the fact that the secondary latch in the inserted state is arranged in a loss-proof manner between the contact support and the outer housing.

It is possible by way of the already described insertion chamfer to fit the contacts into their contact chambers in the simplest manner. Depending upon the geometric shape (for example length of the longitudinal bar and the number of the force-absorbing bumps) of the secondary latch, the fitting procedure may be realized irrespective of the number of pins on the plug connector (pin number equal to the number of contacts). In addition, the secondary latch may be adapted in a simple manner to suit the geometric shapes used with respect to the contacts and its associated contact support.

BRIEF DESCRIPTION OF THE DRAWING

An embodiment of the invention is illustrated in the FIGS. and further explained below. Therein.

SPECIFIC DESCRIPTION OF THE INVENTION

Figure 1:
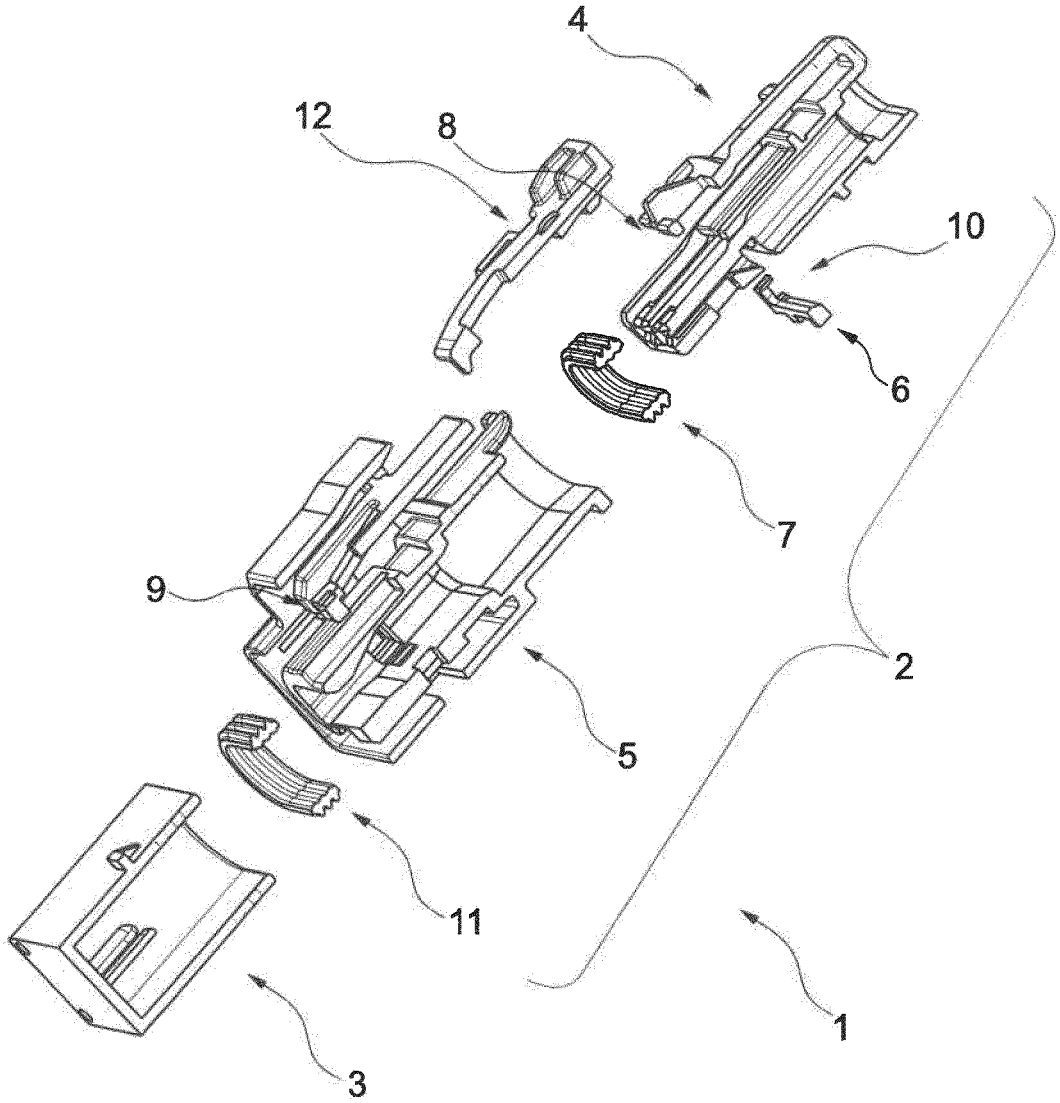
FIG. 1 is an exploded view of the invention.

FIG. 1 shows, insofar as the detail illustrates, a plug connection 1. This plug connection 1 has a plug connector 2 and a mating plug connector 3 that may be plugged together with this plug connector. Some elements of the plug connection 1 (such as for example electrical conductors whose ends are provided with contacts) are not illustrated for the sake of a better overview, in practice however they are included and are fundamentally known.

The plug connector 2 is formed by a contact support 4 that has contact chambers, not further illustrated, for the contacts. The contact support 4 is inserted into an outer housing 5 (also referred to as a protective collar). The contacts that are inserted into the contact chambers are primarily latched in a manner known per se and in a suitable manner (so-called primary latching arrangement). Furthermore, a secondary latching procedure is performed by a secondary latch 6 that may be provided but it is not essential to provide such a secondary latch. So as to provide sealing and longitudinal water tightness, a seal designed in particular as a lip seal 7 is inserted between the contact support 4 and the outer housing 5. It is possible but not essential to provide as further elements of the plug connection 1 a latching element 8 (for the contact support 4) and/or a latching element 9 (for the outer housing 5) and/or a latching element 10 (for the secondary latch 6). So as to realize a sealing arrangement and to provide longitudinal water tightness, a further sealing element in particular in the form of a lip seal 11 is provided between the plug connector 2 and the mating plug connector 3 (that is also referred to as a plug-in socket). So as to permanently fix the plug connection 1 that is plugged together from the plug connector 2 and the mating plug connector 3, a further latching element is provided, namely a CPA 12 that is known per se.

Figure 3:
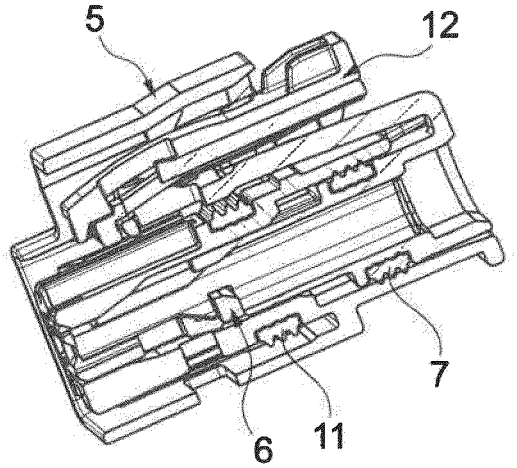
Figure 4:
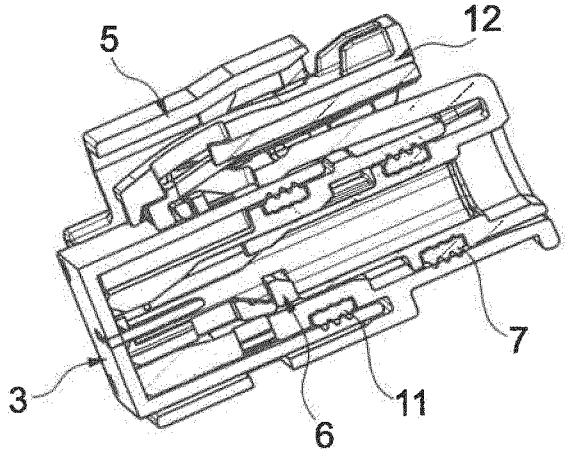

The construction of the above mentioned elements is explained below with the aid of FIGS. 2 to 4.

Figure 2:
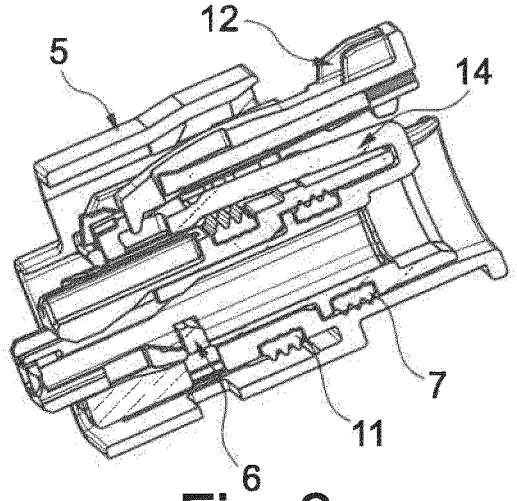
FIGS. 2-4 are sectional views through the contact support and housing of the invention.

FIG. 2 illustrates that the contact support 4 has been inserted in part into its outer housing 5 with the result that this contact support is located in a first position in the outer housing 5, this first position being referred to as the pre-latched position. Starting from this pre-latching position, it is possible to move the contact support 4 further into the outer housing 5 until the intended final position has been realized. In the pre-latched position, as illustrated in FIG. 2, the contact support 4 projects by way of example 3.45 mm out of the outer housing 5. Greater or smaller distances are naturally also conceivable. After the contacts (for example contact sockets) have been inserted in their associated contact chambers in the contact support 4 and have been primarily latched there, the contacts are secondarily latched in their contact chambers by the secondary latch 6. Subsequently, the plug connector 2 is further assembled and the plug connector 2 is plugged together with its mating plug connector 3. As soon as the contact support 4 still in the pre-latched position projects out of the outer housing 5 comes into contact with a contact area, for example a base, of the mating plug connector 3, the outer housing 5 likewise moves until it arrives at the contact area (in particular the base) of the mating plug connector 3, as a result of which the outer housing 5 and the contact support 4 are pushed further together one inside the other with the result that the contact support 4 is subsequently in the intended manner in its final position in the outer housing 5 and the outer housing 5 and the contact support 4 form a planar surface at the end face (i.e. in the direction of the mating plug connector 3). By virtue of this state illustrated in FIG. 3, the contact support 4 is consequently fixed in the intended manner in its outer housing 5. This position is also referred to as the final latched position of the plug connector 2. As illustrated in FIG. 4, the mating plug connector 3 is then inserted into the prepared plug connector 2 as described above with the result that the plug connection 1 is plugged together. Finally, this plug connection 1 is secured by actuating the CPA 12 with the result that it is not possible without releasing the CPA 12 to move the mating plug connector 3 back out of the plug connector 2.

Figure 5:
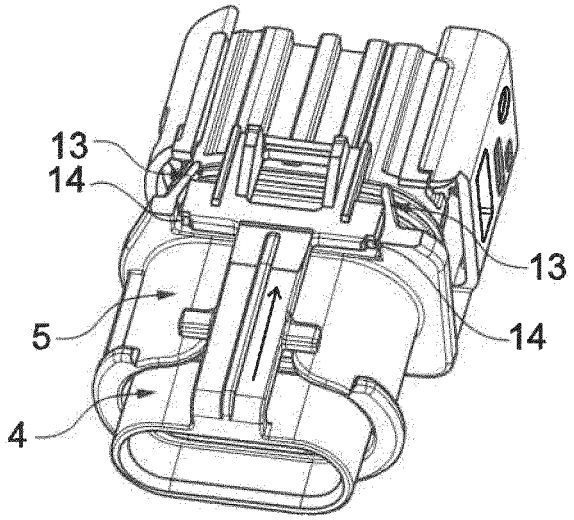
FIGS. 5-7 are perspective views of details of FIGS. 2-3.

It is apparent in FIG. 2 that the contact support 4 has been moved into its first position relative to the outer housing 5, this first position being the described pre-latched position. In order to effectively prevent the contact support 4 from moving out of this pre-latching position out of the outer housing 5, the outer housing 5 has in accordance with the invention at least one latching hook 13 that cooperates with the contact support 4, wherein the contact support 4 has a geometric shape 14 that mates with this latching hook and the at least one latching hook 13 is oriented in an oblique manner with respect to the middle axis of the outer housing 5. This is illustrated in FIG. 5, wherein in this case an embodiment is illustrated in which two latching hooks 13 are on the outer housing 5 in a symmetrical manner with respect to the middle axis of the outer housing 5.

Figure 6:
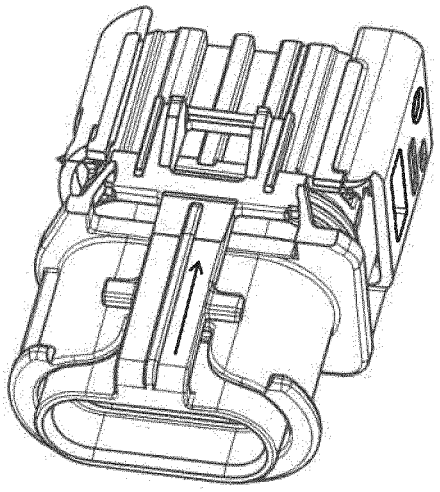
Figure 7:
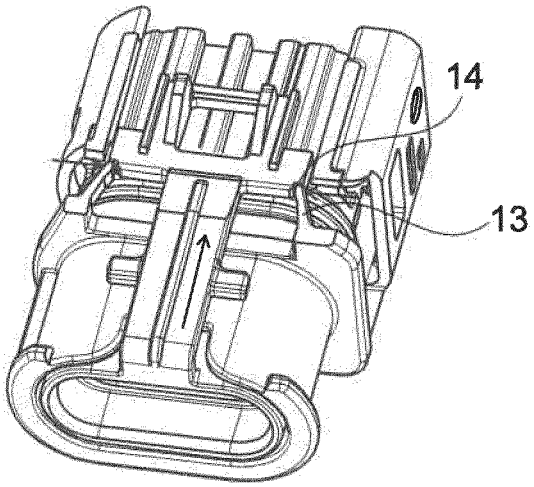

As the contact support 4 is assembled (inserted) in its outer housing 5, the two latching hooks 13 are splayed apart to the left-hand side and the right-hand side with the result that the contact support 4 that is guided through these two latching hooks 13 that are splayed apart may be inserted (pushed) into the outer housing 5. If the contact support 4 is subsequently moved into its intended position (by way of example the pre-latched position) the two latching hooks 13 move back into their original position and come into contact with the geometric shape 14 that mates with this latching hook and as a result these latching hooks prevent the contact support 4 from moving out of its assumed position out of the outer housing 5. FIG. 6 illustrates the procedure of the contact support 4 sliding along at the two latching hooks 13 that are splayed apart, wherein it is apparent in FIG. 7 that the respective free end of the two latching hooks 13 has come into contact with the geometric shape 14 that mates with this latching hook. The orientation of the latching hooks 13 is in this case in a preferred manner almost identical or even completely identical prior to and after the contact support 4 has been inserted in its outer housing 5.

FIGS. 8 to 11 illustrate again in different perspective views both the latching hooks 13 of the outer housing 5 and also the geometric shape 14 of the contact support 4, this geometric shape mating with this latching hook.

Figure 11:
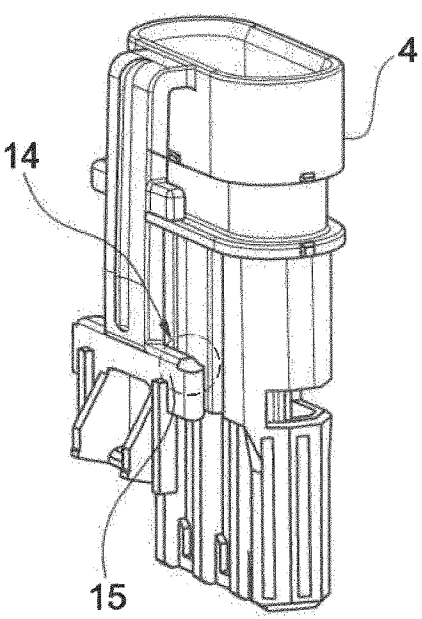
FIGS. 8-13 are mainly sectional views of details of the invention.
Figure 10:
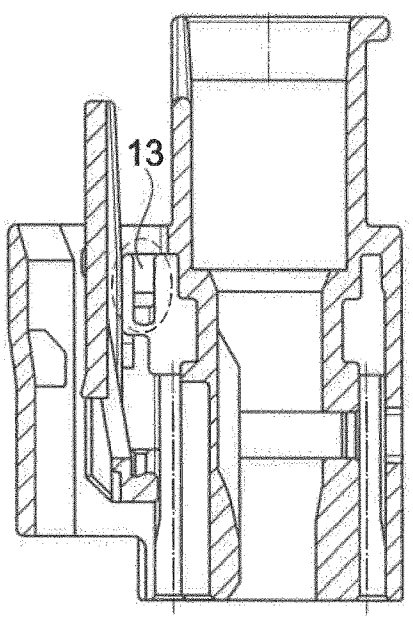
Figure 9:
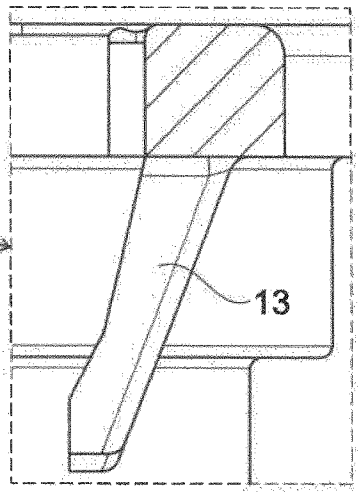
Figure 8:
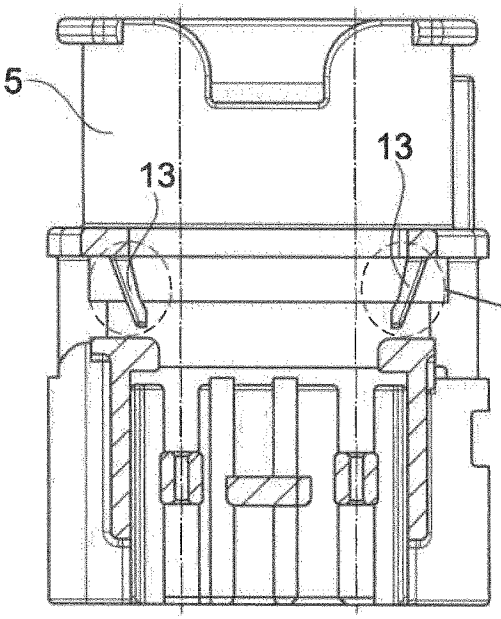

With reference to FIGS. 10 and 11, it is still to be explained that the geometric shape 14 that mates with this latching hook is on one end of a transverse web 15 that extends from the middle axis of the contact support 4. As is clearly apparent in FIG. 11, the transverse web 15 is also configured with its geometric shape 14 that mates with this latching hook and is at each respective end in a symmetrical manner with respect to the longitudinal axis of the contact support 4. In addition, it is apparent that the end of the transverse web 15 is configured with its geometric shape 14 that mates with this latching hook as a free end that projects from the surface of the contact support 4. As a consequence, it is possible to produce this geometric shape 14 that mates with this latching hook, in a very simple manner using a synthetic material injection molding method since this geometric shape may be reproduced in the corresponding injection molding tool and also this geometric shape may be removed from this injection molding tool in a correspondingly simple manner.

Figure 13:
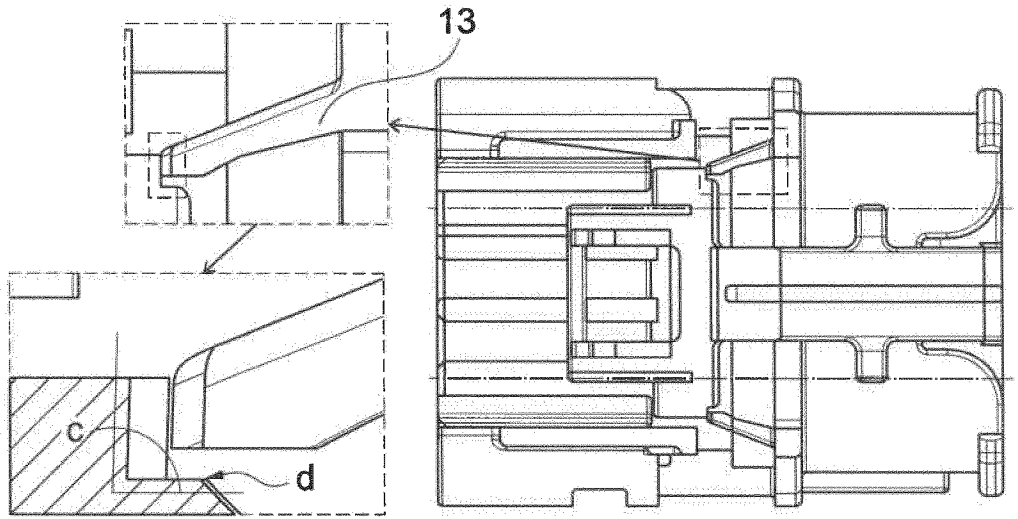
Figure 12:
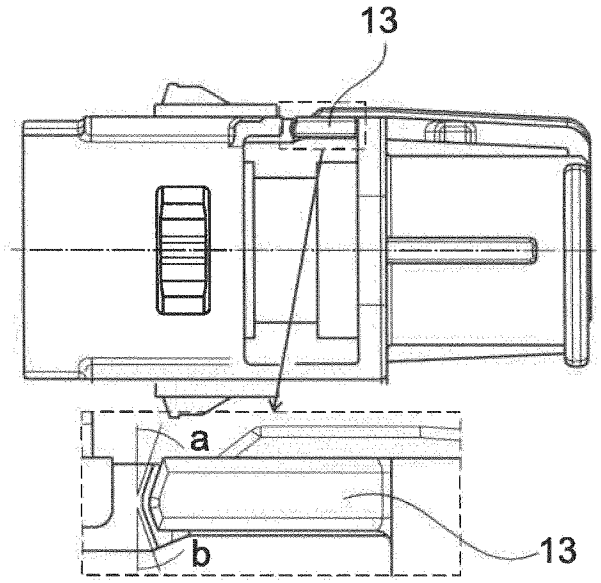

When considering FIGS. 12 and 13 that again illustrate in detail the arrangement and the cooperation of the latching hooks 13 with the geometric shape 14 that mates with this latching hook, it is apparent that by virtue of the cooperation between the latching hooks 13 and the geometric shape 14 of the contact support 4, this geometric shape mating with this latching hook, the contact support 4 is prevented from moving out of the outer housing 5 even in the case of high loadings. It is necessary to prevent this contact support from being moved (pushed out) of this outer housing in particular then and therefore effectively if the mating plug connector 3 is inserted into the plug connector 2. This effective prevention is achieved by an undercut contour of the angles a and b that are formed both on the free ends of the latching hooks 13 and also on the corresponding contact surface of the geometric shape 14 that mates with this latching hook and a defined loading direction is ensured by the slight oblique position of the latching hooks 13 in relation to the longitudinal axis of the plug connection 1. In addition, by virtue of the cooperation of the illustrated and described geometric shape, the latching hooks 13 are prevented from moving (for example from opening out). The defined stop d on the contact support 4 (cf. again FIG. 13, the lower left-hand illustration) prevents the latching hooks 13 from bending away inward across the angle c (cf. FIG. 13, lower left-hand illustration).

Whereas FIGS. 1 to 4 illustrate the construction and the operating principle of an example of a plug connection as described above, FIGS. 5 to 13 illustrate based on this embodiment the latching hooks 13 on the contact support 4 in conjunction with the geometric shape 14 that mates with this latching hook on the outer housing 5 as likewise described above.

The secondary latch 6 that may be inserted into the contact support 4 is now described below on the basis of FIGS. 14 to 21.

It goes without saying that the embodiment and the associated description may be realized in relation to the secondary latch 6 alone in a plug connector just as the latching hook 13 may be realized in conjunction with the geometric shape 14 that mates with this latching hook. In contrast, the combination of these two elements (secondary latch 6 and latching hook 13) is illustrated and described.

Figure 14:
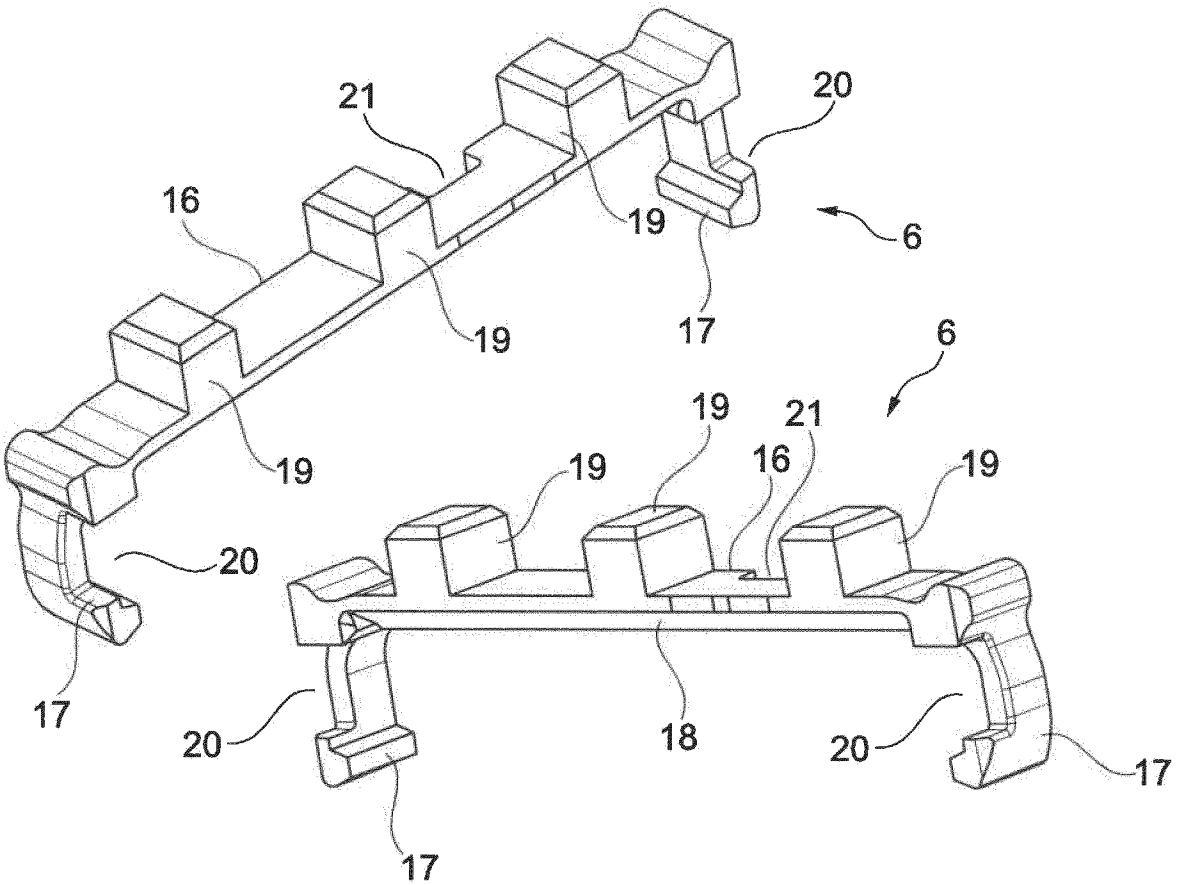
FIG. 14 shows two views of the secondary-latch clip of this invention.

FIG. 14 illustrates the secondary latch 6 in two different views. Fundamentally, this secondary latch has an elongated shape and has a particularly planar longitudinal bar 16. Each end of this longitudinal bar 16 is provided with a latching element 17. The latching element 17 is configured as a tab that projects somewhat at a right angle from the longitudinal bar 16 and in turn a shoulder that forms in particular an undercut is on the end of this tab. An end face of the longitudinal bar 16 is not configured at a right angle with respect to the larger surface of the longitudinal bar 16 but rather is chamfered and thus forms an insertion chamfer 18 against which the contacts may slide along into their contact chambers during the insertion procedure and thus the contacts are prevented from becoming jammed during this insertion procedure. Force-absorbing bumps 19 are on the upper face of the longitudinal bar 16. In the case of this embodiment, 3 force-absorbing bumps 19 are provided in a symmetrical manner over the entire length of the longitudinal bar 16. However, it is also possible to provide one, two or more than three force-absorbing bumps 19, wherein the number depends upon the design of the plug connector, in particular upon the number of its contacts. Furthermore, near the latching elements 17, an unlatching notch 20 is provided in the tab that extends at a somewhat right angle starting from the longitudinal bar 16. An unlatching tool is inserted into this unlatching notch 20, the contact support 4 being provided for this purpose with a corresponding opening via which not only the secondary latch 6 may be inserted but rather via which the unlatching notch 20 may also be actuated with the development tool. Finally, the secondary latch 6 that is illustrated in this embodiment has a coding 21. The coding 21 is in this case a notch in a longitudinal side of the longitudinal bar 16.

Figure 15:
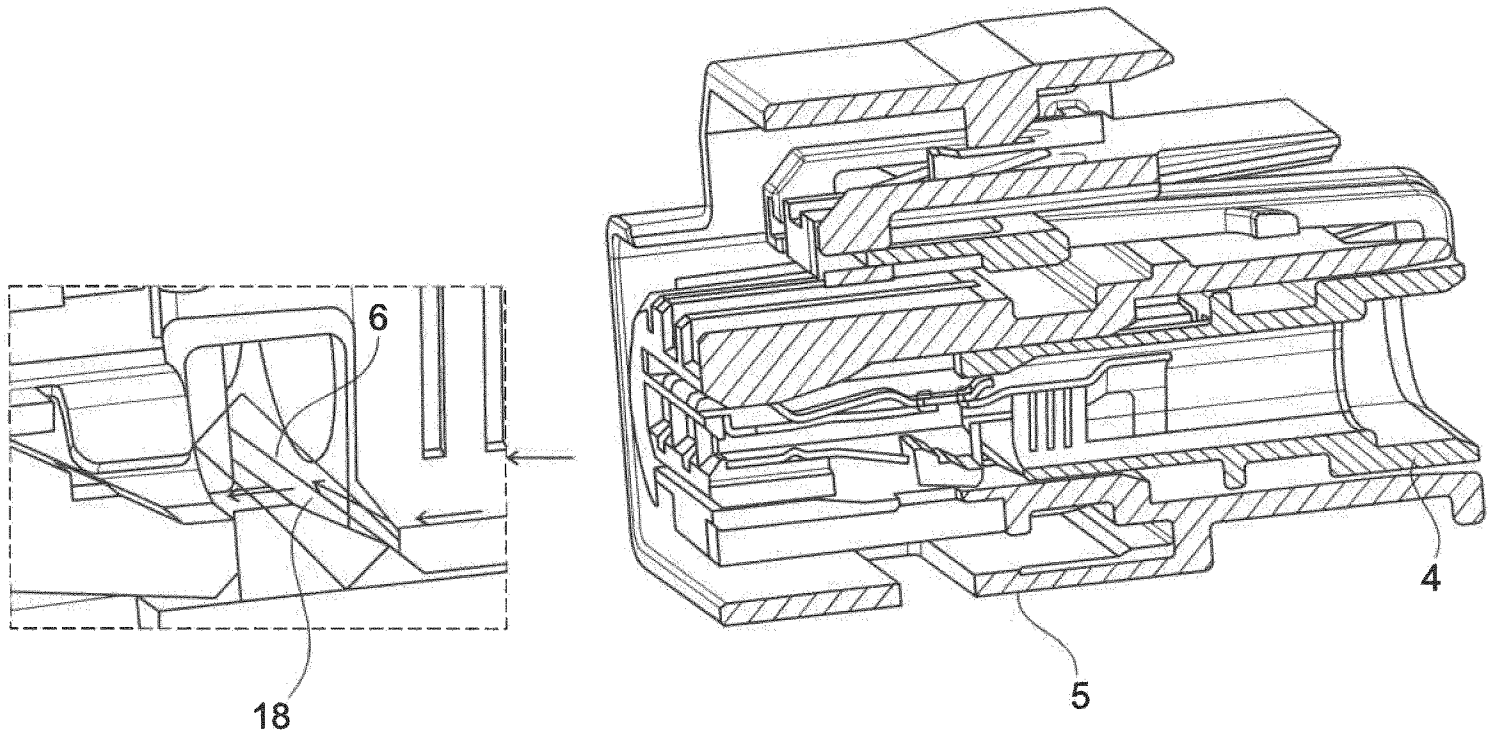
FIGS. 15-21 are perspective and sectional views of elements of this invention.

FIG. 15 illustrates that the insertion chamfer 18 renders it possible in the open state when fitting the contact (inserting the contacts in their associated contact chambers) for the respective contact to be positioned in its associated contact chambers in a frictionless manner. In the open state, this may be on the one hand the pre-latched position of the secondary latch 6 in its contact support 4 in which it is possible to insert the contacts into the contact chambers, but wherein this contacts are not yet secondary latched. The secondary latching procedure is only then performed if the secondary latch 6 has been moved from its pre-latched position into its intended final latched position. However, it is also possible in the open state that the contact support 4 has not yet been inserted into the outer housing 5 or has only been inserted in part into this outer housing.

Figure 16:
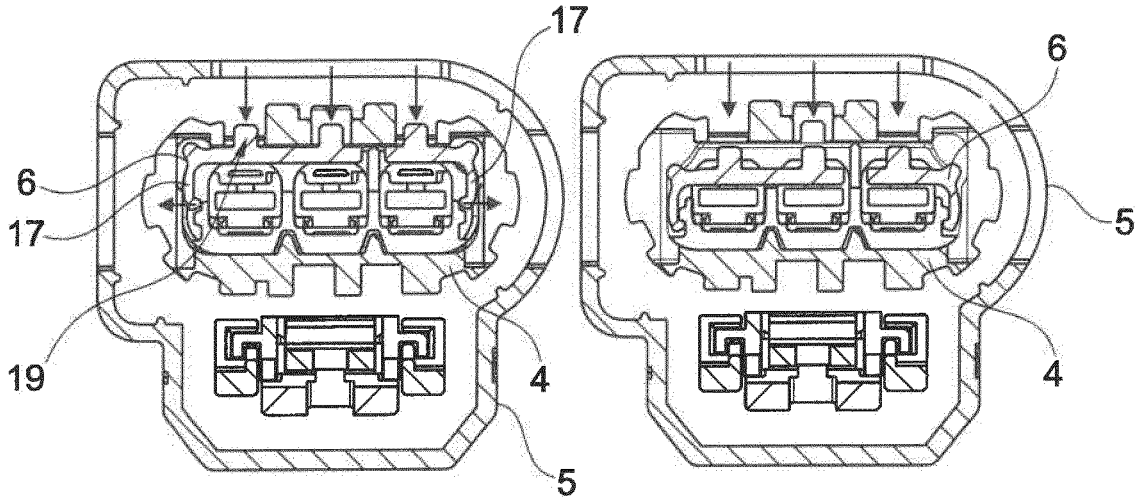
Figure 16:
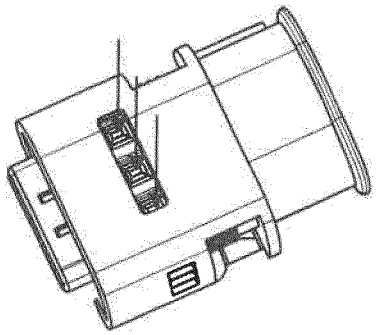

FIG. 16 illustrates the procedure of latching the secondary latch 6 in which this secondary latch 6 is moved from the pre-latched position into its intended final latched position. During this procedure of latching the secondary latch 6, a downward-acting force is applied to the force-absorbing bumps 19. This is illustrated on the left-hand side in FIG. 16. The absorption of force is indicated by the three arrows. This is performed for example with or without a tool, manually or using a machine. During the movement of the secondary latch 6 from its pre-latched position (apparent in the center of FIG. 16) into its final latched position, the two latching elements 17 are in so doing splayed apart and snapped in the end position back into their original position in order to fix and secondary latch the contacts via the longitudinal bar 16 of the secondary latch 6 that is then located in its final latched position. This is apparent in the right-hand illustration in FIG. 16. It goes without saying that the secondary latch 6 is initially inserted into the contact support 4 and is fixed there in its pre-latched position. The latching elements 17 that form a latching geometric shape or rather an undercut geometric shape are tailored with respect to their function to suit a mating latching geometric shape or a mating undercut geometric shape of the contact support 4. Such a mating geometric shape is formed in the embodiment in accordance with FIG. 16 by way of example as a protruding bead on the contact support 4.

Figure 17:
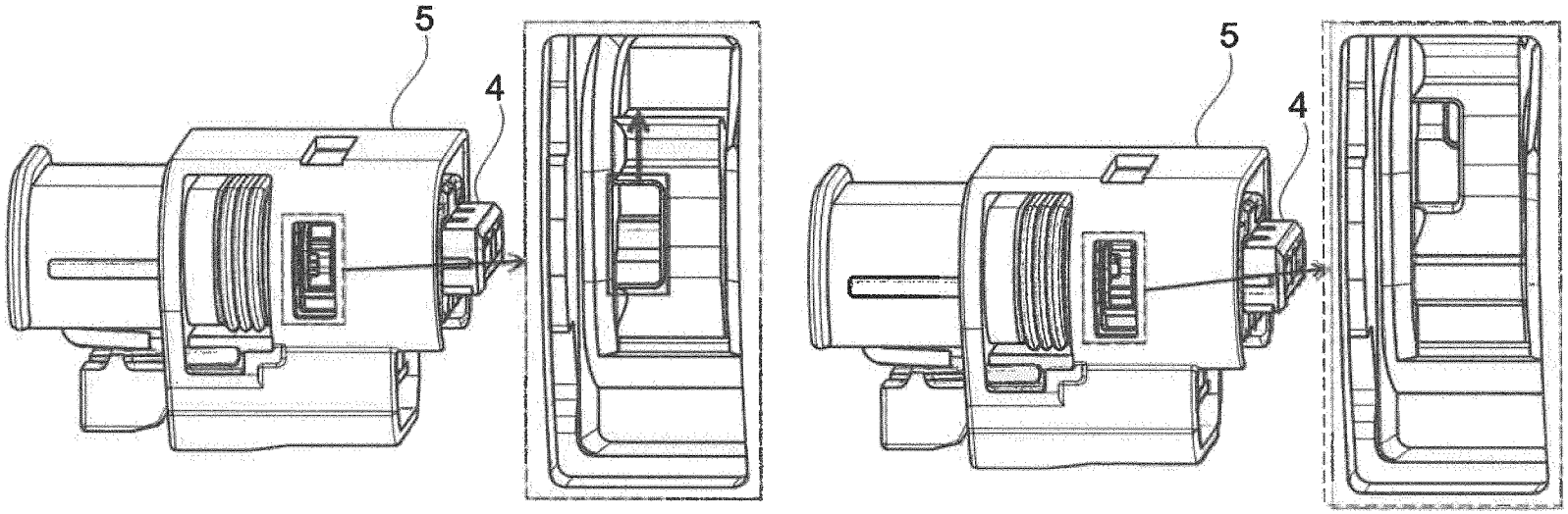

FIG. 17 illustrates a procedure of unlatching the secondary latch 6. During this procedure of unlatching the secondary latch 6, a corresponding unlatching tool is inserted on both sides through a corresponding cut-out in the contact support 4 (and where appropriate in the outer housing 5, after the contact support 4 has been inserted in the intended manner and completely into the outer housing 5), into the unlatching notches 20 and the secondary latch 6 is drawn upward (as viewed in FIG. 17) by this development tool and thus unlatched. It is possible as a result of this unlatching procedure that the contacts (or rather only one or multiple contacts) may be changed for example in the event of an incorrect contacts being fitted or may be replaced in the event of contacts becoming damaged.

Figure 18:
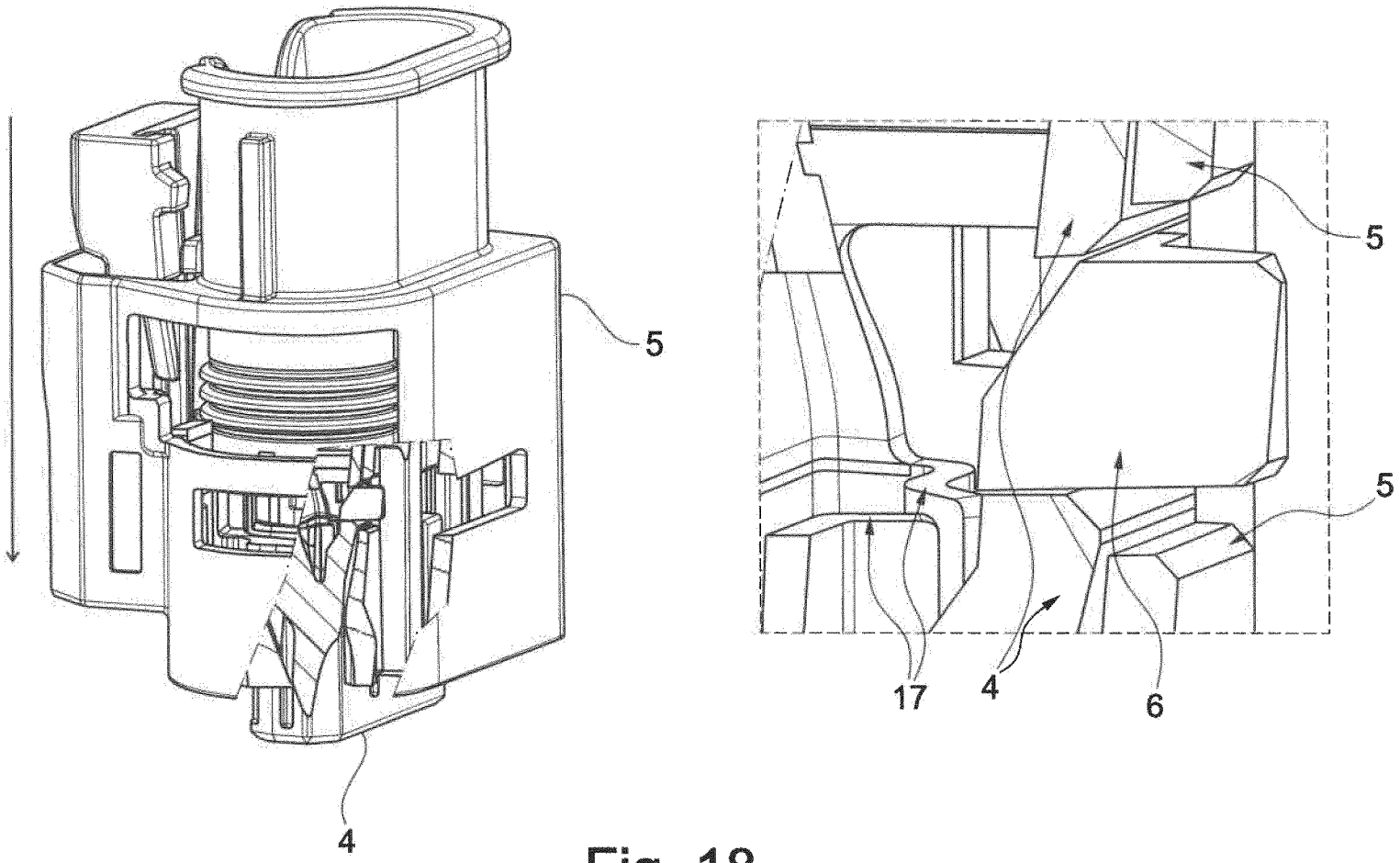
Figure 19:
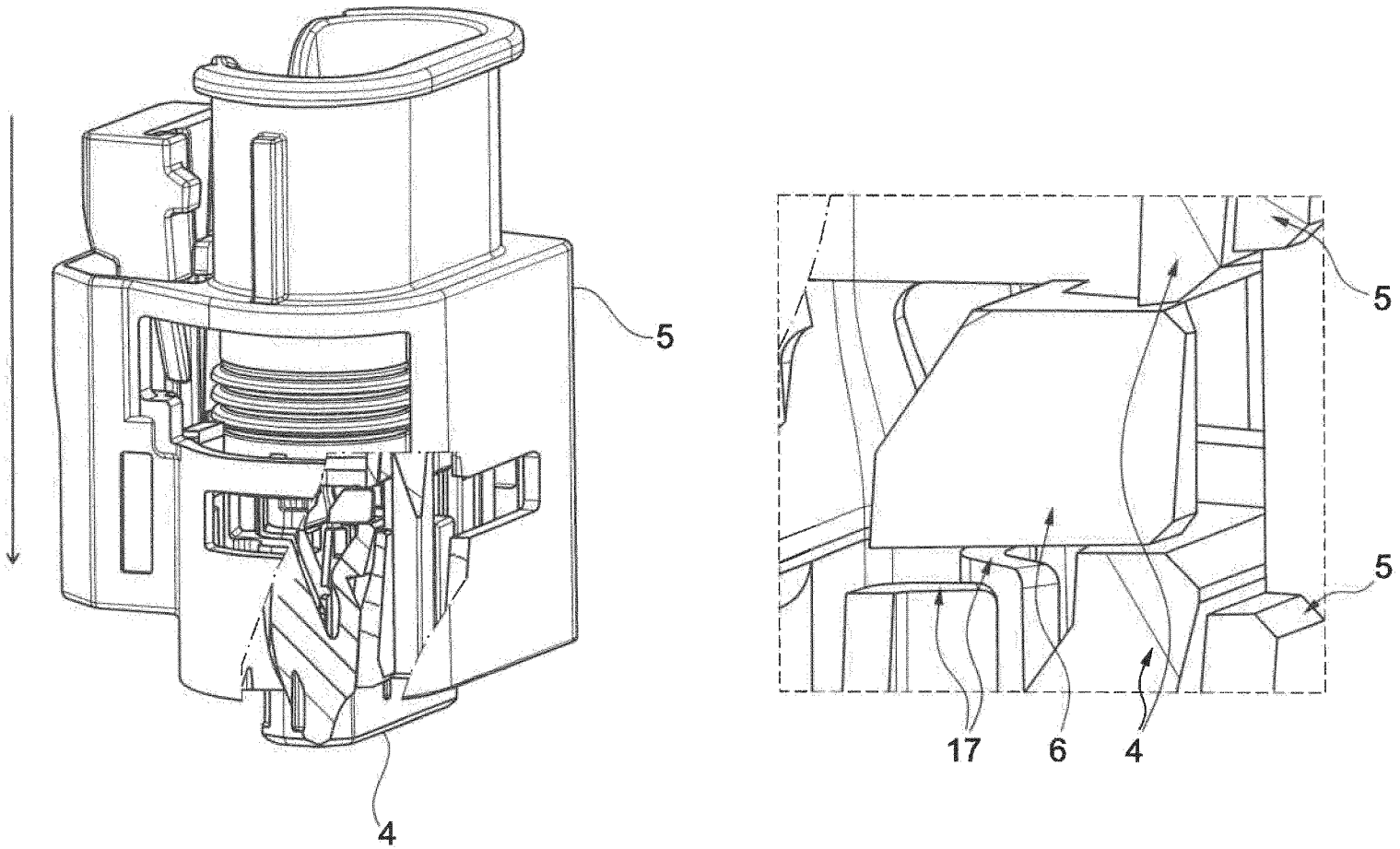

It is apparent in FIG. 18 that the procedure of inserting the contact support 4 into its outer housing 5 is only possible when the secondary latch 6 is in the closed state (final latched position). The relative movement (insertion of the contact support 4 into the outer housing 5) is blocked by the secondary latch 6 that is still open. The term 'open' in this case means that although the secondary latch 6 has already been moved into its pre-latched position in the contact support 4, the final latched position has not yet been realized. The secondary latch 6 is inserted with the force-absorbing bumps 19 both into the contact support 4 and also into the outer housing 5 and prevents the entire system being moved into its final latched position. This means that although the contact support 4 has already been inserted in part into the outer housing 5, it is not yet possible for this contact support to be inserted any further owing to the blockade provided by the secondary latch 6. It is possible when the contact support 4 is in this position in relation to the outer housing 5 for the contacts to be inserted (fitted) into their contact chambers. In this position, the corresponding geometric shapes of the contacts for their secondary latching are not in contact with the secondary latch 6, in particular do not form an undercut (have not yet come into contact with one another) and are therefore not yet fixed in their intended final position (secondary latching arrangement). By virtue of actuating (also referred to as closing) the secondary latch 6, this actuation causing the secondary latch 6 to move from its pre-latched position into its final latched position (cf. FIG. 19), the secondary latch 6 is inserted completely into the contact support 4 with the result that this secondary latch no longer projects beyond the surface of the contact support 4. In other words, the secondary latch 6 then no longer projects out of the outer housing 5. Simultaneously, the secondary latch 6 generates an undercut with respect to the latching geometric shapes of the contacts for the secondary latching procedure and thus ensures that the contacts are correctly positioned in their contact chambers, i.e. these contacts are located in their intended final position. Consequently, in accordance with FIG. 19, each contact is then secondary latched in its associated contact chamber.

Figure 20:
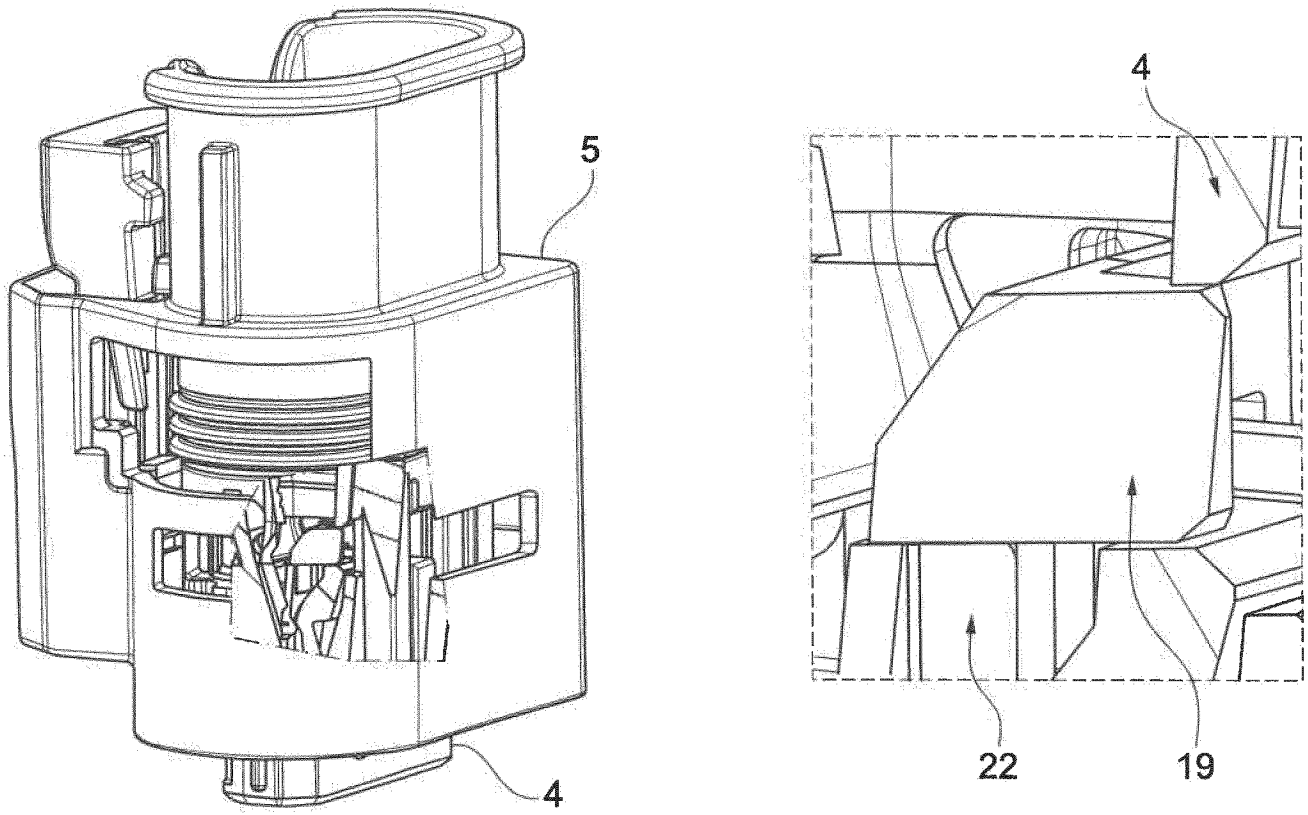

The operating principle of the force-absorbing bumps 19 is described with reference to FIG. 20. The illustrated geometric shape of the force-absorbing bumps 19 ensures that the respective contact is also positioned correctly in its contact chamber. In so doing, when tensioned, the latching geometric shapes of the respective contact (in this case provided with the reference numeral 22) lie against the force-absorbing bump 19 when the secondary latch 6 is located in its intended final position in the contact support 4. As a consequence, by virtue of the fact that this contact lies against the contact support 4 (to be more precise its contact chambers), the contact is permanently and effectively prevented from being displaced in its contact chamber.

Figure 21:
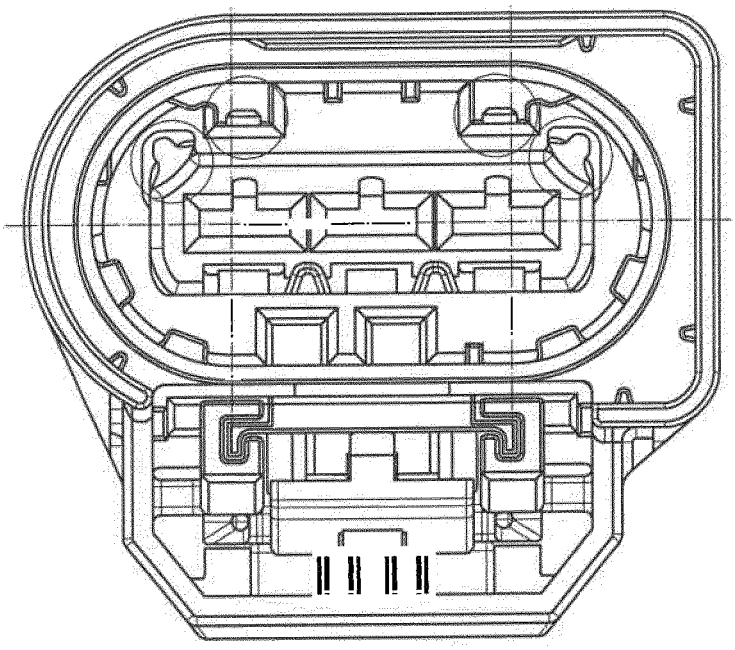
Figure 21:
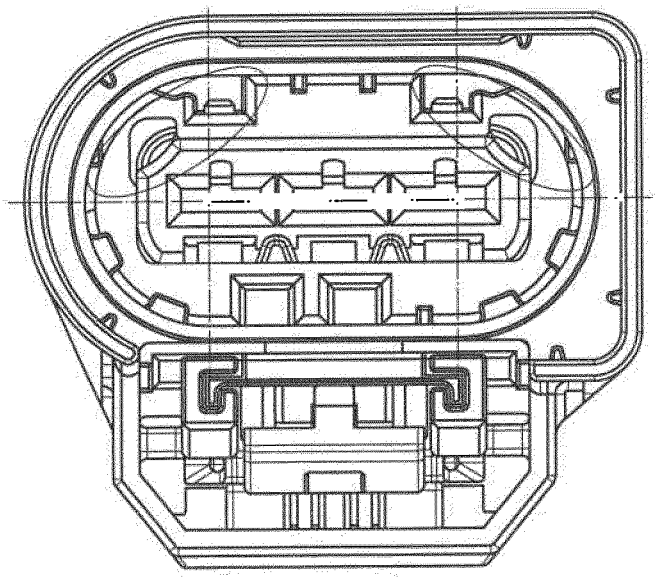

Finally, FIG. 21 illustrates the situation that the contacts may be replaced in a simple and rapid manner when the plug connector 2 is in the fully assembled state. In addition, the pre-latched position and the final latched position of the secondary latch 6 are apparent with the plug connector 2 in the assembled state. The secondary latch 6 may be opened and closed (i.e. this secondary latch may be moved from its pre-latched position into its final latched position on the contact support 4 and conversely) when the plug connector 2 is in the fully assembled state, in which the contact support 4 has been fully inserted into the outer housing 5. In this state or also after the contact support 4 has been moved out of the outer housing 5, the secondary latch 6 may be opened and either a contact fitted in the event that a contact is not located in a contact chamber or, in the event of damage, a damaged contact may be replaced by a new contact.

In addition, the described embodiment and assembly sequence of the secondary latch 6 has the advantage that the position of the secondary latch 6 may be queried at multiple sites and at multiple points in time during the procedure of assembling the plug connector 2 in order to ensure that the plug connector 2 is assembled correctly or rather to detect if this plug connector has been assembled incorrectly. If the secondary latch 6 is inserted into its pre-latched position on the contact support 4 then this may be queried at four sites. This may occur on the extreme left-hand side and extreme right-hand side on the visible position knobs and in the middle on the left-hand side and right-hand side of the two blocked webs. In the final latched position, these are completely inserted into the contact support and are no longer visible. The position knobs and the two blocked webs are apparent in the left-hand illustration of FIG. 21, whereas they are no longer apparent in the right-hand illustration of FIG. 21 with the result that it is possible to query this change of state using corresponding detection means.

The invention claimed is:

1. A plug connection comprising:

a plug connector and a mating connector pluggable together to form the plug connection, a contact support on the plug connector, having at least one contact chamber for receiving a contact, and insertable into an outer housing of the plug connector, each contact being primarily latched in its contact chamber, a secondary latch provided so as to secondarily latch the contacts in their contact chambers, and the secondary latch movable on the contact support between a prelatched position and a final position and formed by a longitudinal bar, two arms extending transversely from ends of the bar to form therewith a U and each provided with a latching element that cooperates with the contact support and in the final position prevents retraction of the contacts from the contact support, and at least one force-absorbing bump on an upper face of the longitudinal bar and engaging in the prelatched position into the outer housing to prevent relative movement of the housing and the contact support.

2. The plug connection as claimed in claim 1, wherein the longitudinal bar of the secondary latch has an insertion chamfer.

3. The plug connection as claimed in claim 1, wherein the longitudinal bar of the secondary latch has at least one unlatching notch near each of its latching elements.

4. The plug connection as claimed in claim 1, wherein the longitudinal bar of the secondary latch has a coding.

5. The plug connection as claim 1, wherein each arm forms with the contact support a respective open notch engageable with a tool for prying the respective arm laterally away from the contact support and freeing the respective latching element from the contact support.

* * * * *